US012702215B2

(12) United States Patent
Zheng et al.

(10) Patent No.: US 12,702,215 B2
(45) Date of Patent: Aug. 11, 2026

(54) AIRTIGHT COSMETIC COMPACT

(71) Applicant: APR Beauty Group Inc, Toronto (CA)

(72) Inventors: Min-Yan Zheng, Richmond Hill (CA); Feng-Ying Fu, Markham (CA)

(73) Assignee: APR Beauty Group Inc., Richmond Hill (CA)

( * ) Notice: Subject to any disclaimer, the term of this patent is extended or adjusted under 35 U.S.C. 154(b) by 256 days.

(21) Appl. No.: 18/680,252

(22) Filed: May 31, 2024

(65) Prior Publication Data

US 2025/0366592 A1 Dec. 4, 2025

(51) Int. Cl.
*A45D 33/00* (2006.01)

(52) U.S. Cl.
CPC ..... *A45D 33/008* (2013.01); *A45D 2200/051* (2013.01)

(58) Field of Classification Search
None
See application file for complete search history.

(56) References Cited

U.S. PATENT DOCUMENTS 6,173,719 B1 * 1/2001 Petit ..... A45D 33/24 206/823
8,789,540 B2 * 7/2014 Lee ..... A45C 13/1084 206/823
9,220,332 B1 * 12/2015 DeVito ..... A45D 33/22
9,345,306 B2 5/2016 Thorpe et al.
2007/0029226 A1 * 2/2007 Yuhara ..... A45D 33/24 206/823
2011/0048443 A1 * 3/2011 Pires ..... A45D 33/003 132/200
2014/0283870 A1 * 9/2014 Byeon ..... A45D 33/006 132/315
2015/0314934 A1 * 11/2015 Eberlein ..... B65D 1/10 215/243
2015/0320174 A1 * 11/2015 Kim ..... A47G 19/00 132/295
2016/0198833 A1 * 7/2016 Kang ..... A45D 33/006 132/286
2017/0143098 A1 * 5/2017 Sugita ..... A45D 33/24
2018/0177277 A1 * 6/2018 Dinata ..... B65D 41/04
2018/0192760 A1 * 7/2018 Lee ..... A45D 33/008
2019/0365074 A1 * 12/2019 Kikuchi ..... A45D 33/006
2020/0170375 A1 * 6/2020 Lee ..... B65D 43/16
2021/0289914 A1 * 9/2021 Hwang ..... A45D 33/003

* cited by examiner

*Primary Examiner* — Nicholas D Lucchesi
(74) *Attorney, Agent, or Firm* — Jason L DeFrancesco

(57) ABSTRACT

An airtight cosmetic compact comprising a base assembly and a cover assembly that are pivotally and rotatably connected. The base assembly includes a base part and an inner tray with a reservoir for storing cosmetic products. The cover assembly comprises an outer cover, an inner cover, and a gasket. The inner cover is pivotally connected to the base assembly, and the outer cover is rotatably connected to both the inner cover and the base assembly. The gasket, attached to the inner cover, creates an airtight seal by abutting an upper rim of the inner tray when the compact is closed and locked. The inner tray, partially housed within the base part, moves axially relative to the base part when the outer cover is twisted to open or close the compact. An elastic member between the inner tray and the base part biases the inner tray upward.

20 Claims, 8 Drawing Sheets

AIRTIGHT COSMETIC COMPACT

BACKGROUND

Field

The present disclosure relates to the technical field of packaging of cosmetic or personal care products, and more particularly to an airtight cosmetic compact.

Description of the Related Art

There exist cosmetic compacts that are convenient to use, and designed to contain volatile and/or aggressive cosmetic products for use. These types of cosmetic compacts usually consist of a cover and a base, that when assembled together provide an effective barrier for the volatile product. The airtight cosmetic compacts may be designed to contain the volatile product with minimal weight loss. Moreover, the airtight cosmetic compacts are designed to contain the volatile cosmetic product with minimal environmental communication. The cover and/or base are typically made of a glass, a plastic, a metal, combinations of the foregoing, or the like, that when closed together create an airtight seal. These covers and base assemblies may be sealed by a thread fastening mechanism, a snap fastening mechanism, or a clamp fastening mechanism, that when fastened together usually compress an o-ring or a gasket interposed by the cover and the base. Such compacts are used in the cosmetics and personal care industries for containing a product to be applied to a body, where, as described above, the product to be applied to the body is volatile and/or aggressive. As such, without the compact's effective barrier, the product may degrade and/or expire.

U.S. Pat. No. 9,345,306 B2 discloses an airtight compact designed to contain a volatile product until use. The compact features a translucent and fragile pot that is partially encased by a base assembly. The base assembly is equipped with a rotatable lid assembly that is pivotably coupled to it. The rotatable lid assembly includes a liner that is over-molded to an inner lid, which directly seals the rim of the fragile pot encased by the base.

Since, these cosmetic compacts are configured to compress a gasket interposed between the cover and the base by tightening the closure and the base, it generally happens that sufficient compression of the gasket is not achieved because the user does not completely close the compact. As a result, the cover and the base are loosely held together and the gasket is not sufficiently compressed to provide airtight seal to the product.

SUMMARY

Accordingly, there is provided an airtight cosmetic compact for storing a cosmetic product according a preferred embodiment of the present disclosure. The airtight cosmetic compact ensures that a gasket is sufficiently compressed when the compact is closed to provide airtight seal.

The airtight cosmetic compact of the present disclosure comprises a base assembly and a cover assembly which is both pivotally and rotatably coupled to the base assembly. The cover assembly comprises an outer cover, an inner cover for holding cosmetic product, and a gasket. The base assembly comprises a base part, an inner tray and an elastic member. The inner tray is movable axially relative to the base part when the outer cover is twisted to open or close the cosmetic compact. The cover assembly is pivotally connected to the base part of the base assembly by means of a hinge assembly. More particularly, the inner cover of the cover assembly is pivotally connected with base assembly by the hinge assembly.

According to an aspect of the present disclosure, the outer cover is rotatable with respect to the inner cover. The outer cover is configured to rotate approximately about 35 degrees in either a counter clock-wise direction or a clock-wise direction about a central longitudinal axis of the airtight cosmetic compact.

According to another aspect of the present disclosure, the inner tray includes a reservoir for storing the cosmetic product. The cover assembly is both pivotally and radially rotatably connected to the base assembly.

The cover assembly is rotatable engaged to the base assembly. More particularly, the inner cover of the cover assembly includes a fastening means to be rotatable coupled to a corresponding fastening means provided on the inner tray of the base assembly, which will be explained in more detail later. However, in alternate embodiments any other rotatable engagement means known in art such as threads may be used for connecting cover assembly to the base assembly in a rotatable manner.

According to another aspect of the present disclosure, the inner cover and the gasket may be integral and can be made by bi-injection molding. The gasket is secured to the inner cover, and wherein an upper rim of the inner tray of the base assembly abuts the gasket to provide an airtight seal when the cosmetic compact is in a closed and locked position.

According an aspect of the present disclosure, the cosmetic compact, the inner tray moves up and down inside the base part when the cover assembly is rotated with respect to the base assembly. In other words, the inner tray is movable axially relative to the base part when the cosmetic compact is opened or closed by twisting the cover assembly on the base assembly. More particularly, the inner tray moves upward relative to the base part, towards the cover assembly, when the cosmetic compact is brought in the closed position from the open position by twisting the cover assembly in a circumferential direction.

According yet another aspect of the present disclosure, the base part has the shape of a flat cylinder, and has an accommodating cavity. The inner tray is accommodated in the accommodating cavity of the base part. The base part includes a bottom wall, a circumferential sidewall extending upward from the peripheral edge of the bottom wall. A side recess is formed in the base part so as to be hinged to a hinge bracket of the inner cover using a hinge shaft.

Further, an inner surface of the circumferential sidewall of the base part includes two axial guide grooves that extend from a distal end toward a proximal end of the circumferential sidewall in the axial direction and are spaced apart at 180 degrees in a circumferential direction. Each of the two axial guide grooves may span about 55 degrees in circumferential direction. Additionally, the inner surface of the circumferential sidewall of the base part includes slide limiting grooves to limit a maximum upward movement of the inner tray in the base part. In other words, the vertical movement of the inner tray is limited by the length of each slide limiting grooves in the height direction of the circumferential sidewall.

Furthermore, the elastic member is provided in the base part between the inner tray and the base part to elastically bias the inner tray in an upward direction. The base part includes at least two arch-shaped ribs extending upward from the inner surface of the bottom wall thereof to support an elastic member. The lower end of the elastic member abuts and surrounds the two arch-shaped ribs, and an upper end of the elastic member abut a bottom surface of a bottom wall of the inner tray to elastically bias the inner tray in an upward direction. The elastic member comprises a coiled spring in this embodiment, however, in alternate embodiments, the elastic member may be any other resilient and biasing member know in the art.

According yet another aspect of the present disclosure, the inner tray is positioned at the upper portion of the accommodating cavity within the base part. The inner tray is accommodated in the base part in a non-rotatable and axially slidable manner relative to the base part. The inner tray includes the bottom wall and a sidewall extending upwardly from a peripheral edge of the bottom wall of the inner tray. An outer surface of the sidewall of the inner tray includes radially outward projections. The radially outward projections of the inner tray configured to be received into the two axial guide grooves and move along the two axial guide grooves in the base part.

Furthermore, each of the radially outward projections of the inner tray includes a camming ramp. The camming ramp has an inlet groove part, an inclined groove part and a locking protrusion formed near a lower end of the inclined groove part. Furthermore, the outer surface of the sidewall of the inner tray have limiting protrusions at a lower end portion thereof. The limiting protrusions are configured to abut upper ends of the slide limiting grooves to limit the upward travel of the inner tray relative to the base part.

According yet another aspect of the present disclosure, the outer cover is generally cylindrical in shape with a closed upper end and an open bottom end. The outer cover has a sidewall extending from a peripheral edge of an upper wall thereof. The inner surface of the sidewall of the outer cover includes two lugs that are diametrically opposite. As the outer cover is turned, the two lugs travel along the camming ramp located on the inner tray. This action results in the axial movement of the inner tray relative to the base part.

Furthermore, the outer cover has two grooves on its sidewall, adjacent to the bottom wall, positioned diametrically opposite each other. These grooves engage with two outer protrusions located on the inner cover, enabling the outer cover to have a limited rotational movement in relation to the inner cover along an outer circumference of the inner cover. Rotation of the outer cover is limited to about 35 degrees by engagement of the grooves and the outer protrusions.

According yet another aspect of the present disclosure, the inner cover has a flat circular disc wall, from which a hinge bracket extends downward from an inner surface of the flat circular disc wall close to peripheral edge thereof. This hinge bracket provides a pivotal connection between the base part and the inner cover. The flat circular disc wall has the two outer protrusions that are diametrically opposite and that extend radially outward from the peripheral edge of the flat circular disc wall.

Additionally, the inner cover has a well area on inner surface of the flat circular disc wall to house a mirror. Furthermore, the inner surface of the flat circular disc wall of the inner cover has an annular grooved area close to the peripheral edge of the inner cover to receive the gasket therein. The annular grooved area of the flat circular disc wall has through slots formed therein to receive locking projections of the gasket.

According yet another aspect of the present disclosure, the gasket has a flat ring structure, and has locking projections formed on an upper surface thereof. The locking projections has width greater than the width of the flat ring structure. The flat ring structure is received into the annular grooved area of the inner cover and the locking projections are received in the through slots of the inner cover.

During use, when the outer cover is rotated to the closed position, the two lugs travel in the camming ramps of the inner tray, which allow the cover assembly to directly compress the gasket to the rim of the inner tray. Further, when the outer cover is rotated to the open position the two lugs travel out from the camming ramps of the inner tray, which provides for the cover assembly to be pivoted away from base assembly and into the unlocked and open position.

In the open position of the cosmetic compact, the elastic member biases the inner tray to its maximum upward slide limit. To close the cosmetic compact, the cover assembly is pivotally rotated along the hinge assembly to cover an open upper end of the base assembly. Next, the outer cover is rotated around the central axis of the cosmetic compact. This action causes each of the two lugs on the outer cover to enter the corresponding camming ramps through the inlet groove parts. The lugs then descend along the inclined groove parts, overriding the locking protrusion near the lower end of the inclined groove parts, thereby locking the cover assembly onto the base assembly.

As the two lugs enter the camming ramp through the inlet groove parts, the inner tray is pushed down slightly against the upward biasing force of the elastic member. With further rotation of the outer cover, each of the two lugs travels along the corresponding inclined groove parts towards the lower end of the camming ramps, pushing the inner tray in the axial upward direction. The lugs then reach the lower end of the camming ramps, overriding the locking protrusion, locking the cover assembly onto the base assembly. Also, at the locking position, the inner tray reaches its maximum upward slide limit. In this position, the rim of the inner tray snugly abuts the gasket of the cover assembly, creating an airtight seal.

The cosmetic compact is brought in the open position from the closed position by rotating the outer cover about the central axis of the cosmetic compact. On rotating the outer cover, the two lugs, initially located at the lower end of the camming ramps on the inner tray, override the locking protrusions to travel along the inclined groove parts towards inlet groove parts to exit the camming ramps. As the two lugs travel along the inclined groove parts and inlet groove parts, the inner tray is forced to move downward relative to the base part, breaking the airtight seal between the rim of the inner tray and the gasket. Once the two lugs disengage from the camming ramps, the cover assembly and base assembly are no longer locked together. Subsequently, the inner tray is pushed upward by the biasing force of the elastic member, returning to its maximum upward slide limit position. The cover assembly is then pivoted about the hinge to open the cosmetic compact, allowing the consumer access to the cosmetic product stored in the inner tray.

The base part, inner tray, outer cover and inner cover may comprise plastic such as ABS, SAN, or metal, or any other suitable material, or the like that is suitable and provide the structural strength necessary for mechanical.

The cosmetic compact of the present disclosure is simple in its design and offer a highly effective seal for the cosmetic product stored inside, even over long durations. This design greatly minimizes the risk of evaporation of volatile cosmetic product in the stored cosmetic product.

Additional advantages, features, characteristics and aspects of the present invention follow from the claims and the following description of a preferred embodiment with reference to the drawing.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

DETAILED DESCRIPTION

Figure 1:
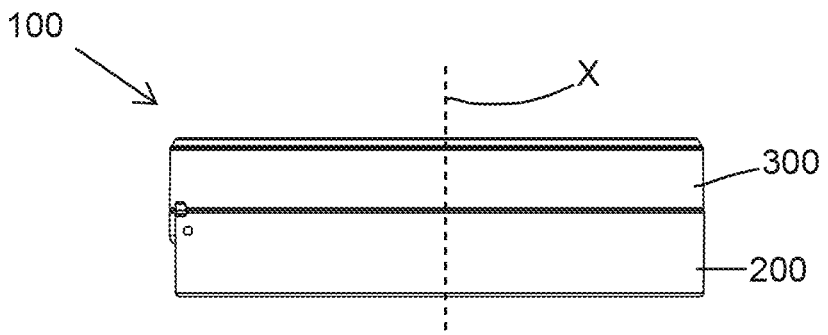
FIG. 1 illustrates a front view of an airtight cosmetic compact of in a closed position according to one embodiment of the present disclosure.

As shown throughout the drawings, like reference numerals designate like or corresponding parts. While illustrative embodiments of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered limited by the foregoing description.

The terms "comprise" (and any form of comprise, such as "comprises" and "comprising"), "have" (and any form of have, such as "has" and "having"), "contain" (and any form of contain, such as "contains" and "containing"), and "include" (and any form of include, such as "includes" and "including") are open-ended linking verbs. As a result, a system or method that "comprises," "has," "contains," or "includes" one or more elements possesses those one or more elements, but is not limited to possessing only those one or more elements or steps. Likewise, an element of a system or method that "comprises," "has," "contains," or "includes" one or more features possesses those one or more features, but is not limited to possessing only those one or more features. Furthermore, a structure that is configured in a certain way must be configured in at least that way, but also may be configured in a way or ways that are not specified.

By way of introduction, the airtight cosmetic compact 100 to be described features a total of three basic operating positions, namely an open position wherein the cosmetic product of the cosmetic compact are made available to the user; a closed and unlocked position in which a cover assembly 300 of the compact 100 only covers the base assembly 200; and a closed, locked and sealed position, which avoids inadvertent opening, and simultaneously effects an air-tight seal of the compact's contents. In the following description, the terms 'closed and sealed'; and 'closed and locked' will be used interchangeably, and are intended to be equivalent terms throughout.

Referring to FIGS. 1-5, which illustrates an airtight cosmetic compact 100 for storing a cosmetic product according a preferred embodiment of the present disclosure. The cosmetic compact 100 comprises a base assembly 200 and a cover assembly 300 which is both pivotally and rotatably coupled to the base assembly 200.

Figure 3:
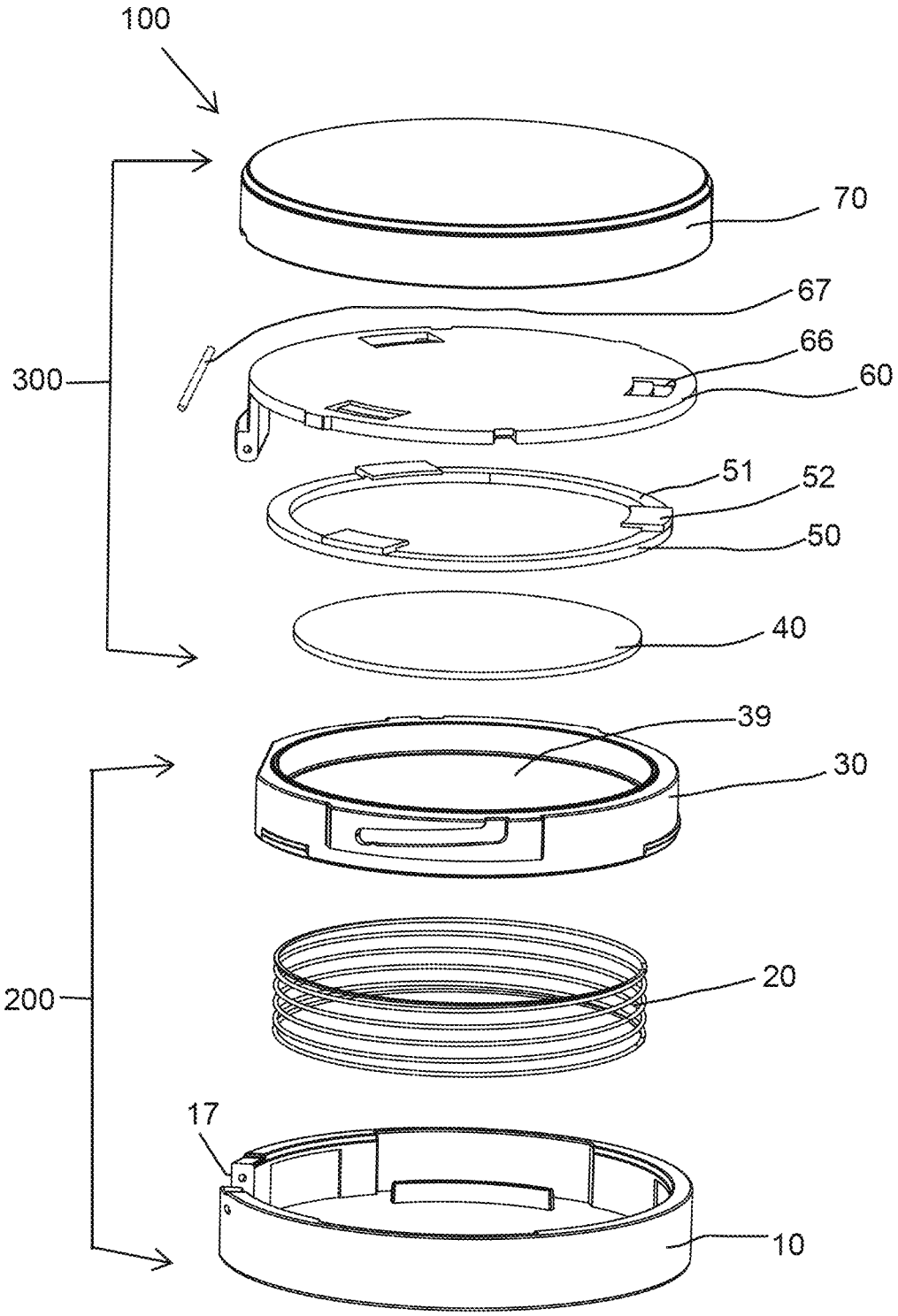
FIG. 3 illustrates an exploded view of the airtight cosmetic compact of FIG. 1.

As shown in FIG. 3, the cover assembly 300 comprises an outer cover 70, an inner cover 60 for holding cosmetic product, and a gasket 50. Further, the cover assembly 300 may also include a mirror 40. According to an aspect of the present disclosure, the inner cover 60 and the gasket 50 may be integral and can be made by bi-injection molding. The rotation of the outer cover 70 unlocks and locks the cover assembly 300 to the base assembly 200.

According to an aspect of the present disclosure, the outer cover 70 has a limited rotatable movement with respect to the inner cover 60. Particularly, the outer cover 70 is configured to rotate approximately about 35 degrees in either a counter clock-wise direction or a clock-wise direction about a central longitudinal axis X disposed substantially proximate to a center of the airtight cosmetic compact 100.

As seen in FIG. 3, the base assembly 200 comprises a base part 10, an inner tray 30 and an elastic member 20. The inner tray 30 includes a reservoir 39 for storing the cosmetic product (not shown). The cover assembly 300 is both pivotally and radially rotatably connected to the base assembly 200.

The cover assembly 300 is pivotally connected to the base part 10 of the base assembly 200 by means of a hinge assembly 400. More particularly, the inner cover 60 of the cover assembly 300 is pivotally connected with base assembly 200 by the hinge assembly 400 see FIGS. 2 and 4.

The cover assembly 300 is rotatable engaged to the base assembly 200. More particularly, the inner cover 60 of the cover assembly 300 includes a fastening means to be rotatable coupled to a corresponding fastening means provided on the inner tray 30 of the base assembly 200, which will be explained in more detail later. However, in alternate embodiments any other rotatable engagement means known in art such as threads may be used for connecting cover assembly 300 to the base assembly 200 in a rotatable manner.

Figure 4:
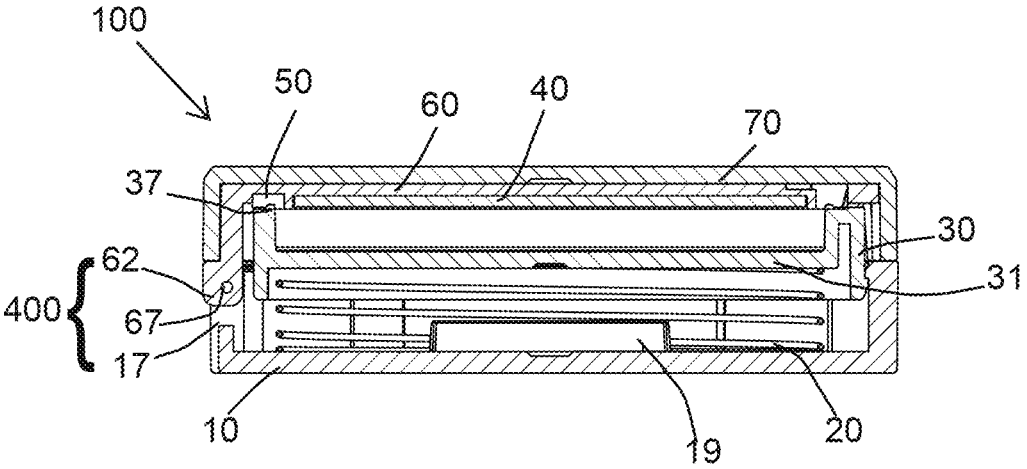
FIG. 4 illustrates a cross-sectional view of the airtight cosmetic compact of FIG. 1.

Further, as shown in FIG. 4, the gasket 50 is secured to the inner cover 60, and wherein an upper rim 37 of the inner tray 30 of the base assembly 200 abut the gasket 50 to provide an airtight seal when the cosmetic compact 100 is in a closed position.

According an aspect of the present disclosure, the cosmetic compact 100, the inner tray 30 moves up and down inside the base part 10 when the cover assembly 300 is rotated with respect to the base assembly 200. In other words, the inner tray 30 is movable axially relative to the base part 10 when the cosmetic compact 100 is opened or closed by twisting the cover assembly 300 on the base assembly 200. More particularly, the inner tray 30 moves upward relative to the base part 10, towards the cover assembly 300, when the cosmetic compact 100 is brought in the closed position from the open position by twisting the cover assembly 300 in a circumferential direction.

Figure 6:
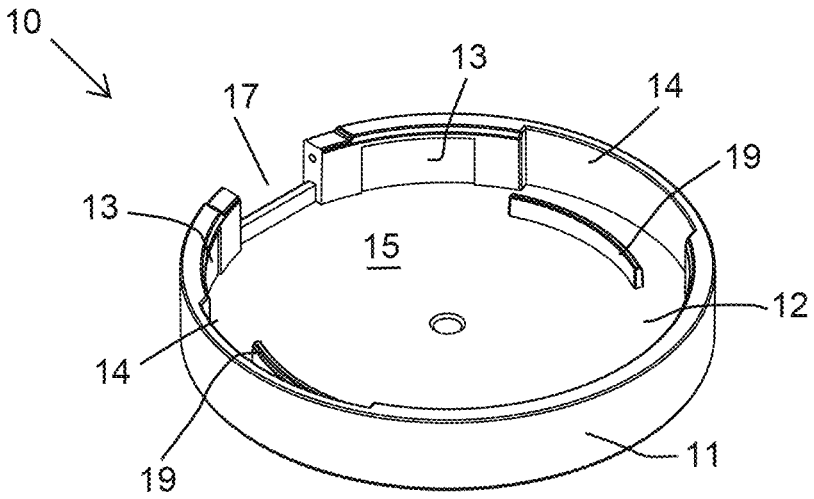
FIG. 6 illustrates a perspective view of a base part of the airtight cosmetic compact of FIG. 3.

Referring to FIG. 6, the base part 10 has the shape of a flat cylinder, and has an accommodating cavity 15. The inner tray 30 is accommodated in the accommodating cavity 15 of the base part 10. The base part 10 includes a bottom wall 12, a circumferential sidewall 11 extending upward from the peripheral edge of the bottom wall 12. A side recess 17 is formed in the base part 10 so as to be hinged to the hinge bracket 62 of the inner cover 60 using a hinge shaft 62, see FIG. 3. The hinge assembly 400 is constituted by the side recess 17 of the base part, hinge bracket 62 of the inner cover 60, and the hinge shaft 67, refer FIG. 4.

An inner surface of the circumferential sidewall 11 of the base part 10 includes two axial guide grooves 14 that extend from a distal end toward a proximal end of the circumferential sidewall 11 in the axial direction and are spaced apart at 180 degrees in a circumferential direction. The two axial guide grooves 14 may span about 45-70 degrees in circumferential direction, particularly 55 degrees in present embodiment. Additionally, the inner surface of the circumferential sidewall 11 of the base part 10 includes slide limiting grooves 13 to limit an upward movement of the inner tray 30 in the base part 10. In other words, the vertical movement of the inner tray 30 is limited by the length of each slide limiting grooves 13 in the height direction of the circumferential sidewall 11.

Figure 5:
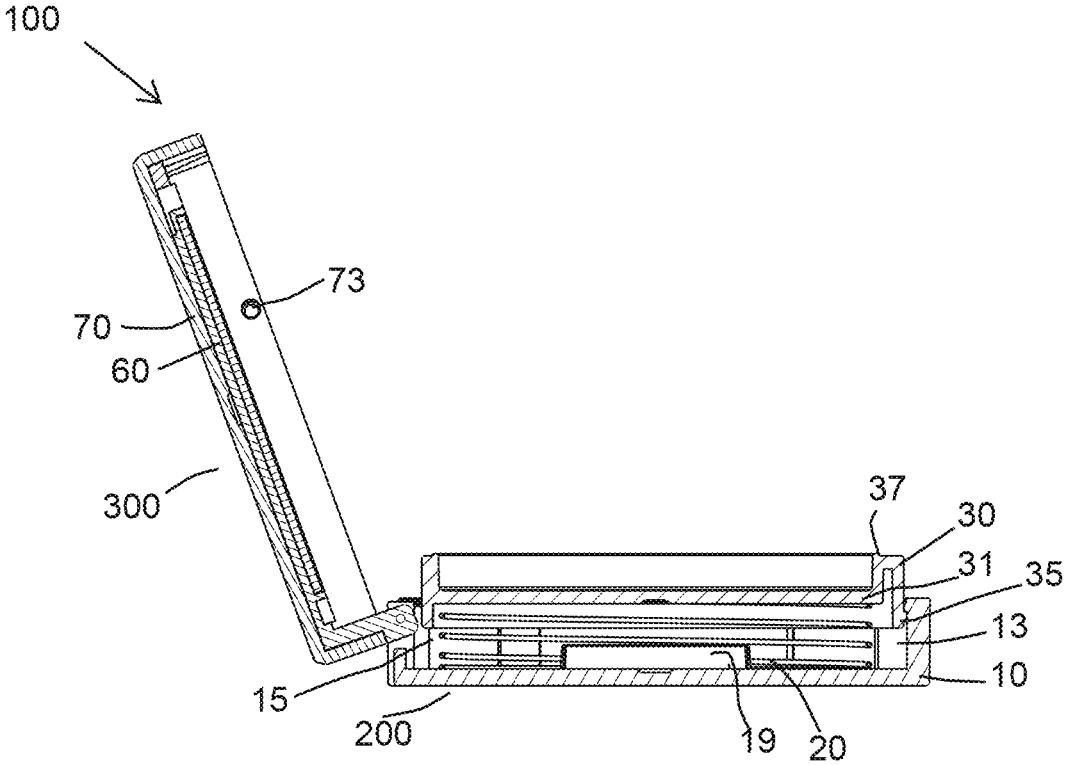
FIG. 5 illustrates a cross-sectional view of the airtight cosmetic compact of FIG. 1 in an open position.

Furthermore, the elastic member 20 is provided in the base part 10 between the inner tray 30 and the base part 10 to elastically bias the inner tray 30 in an upward direction. The base part 10 includes at least two arch-shaped ribs 19 extending upward from the inner surface of the bottom wall 31 thereof to support an elastic member 20. As seen in FIGS. 4 and 5, the lower end of the elastic member 20 abuts and surrounds the arch-shaped ribs 19, and upper end of the elastic member 20 abut a bottom surface of a bottom wall 31 of the inner tray 30. The elastic member 20 comprises a coiled spring in this embodiment, however, in alternate embodiments, the elastic member 20 may be any other resilient and biasing member know in the art.

Figure 7:
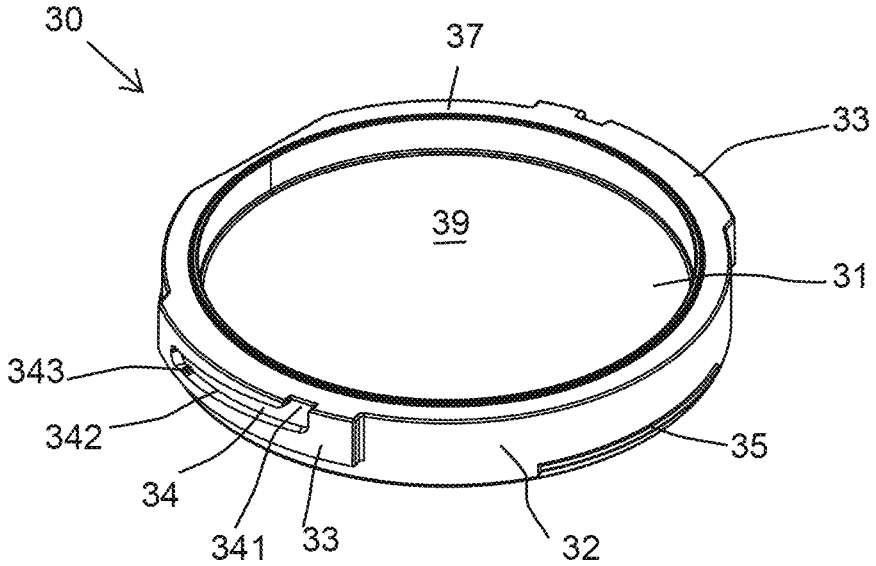
FIG. 7 illustrates a perspective view of an inner tray of the airtight cosmetic compact of FIG. 3.

Referring to FIGS. 4 and 5, the inner tray 30 is provided on the upper portion of the accommodating cavity 15 of the base part 10. The inner tray 30 is accommodated in a non-rotatable and axially slidable manner in the base part 10. As seen in FIG. 7, the inner tray 30 includes the bottom wall 31 and a sidewall 32 extending upwardly from a peripheral edge of the bottom wall 31 of the inner tray 30. An outer surface of the sidewall 32 of the inner tray 30 includes radially outward projections 33. The radially outward projections 33 of the inner tray 30 configured to be received into the two axial guide grooves 14 and move along the two axial guide grooves 14 in the base part 10.

Furthermore, each of the radially outward projections 33 of the inner tray 30 includes a camming ramp 34. Each of the camming ramps 34 has an inlet groove part 341, an inclined groove part 342 and a locking protrusion 343 formed near a lower end of the inclined groove part 342. Furthermore, the outer surface of the sidewall 32 of the inner tray 30 have limiting protrusions 35 at a lower end portion thereof. The limiting protrusions 35 are configured to abut upper ends of the slide limiting grooves 13 of the base part 10 to limit the upward travel of the inner tray 30 relative to the base part 10, refer FIG. 5.

Figure 8:
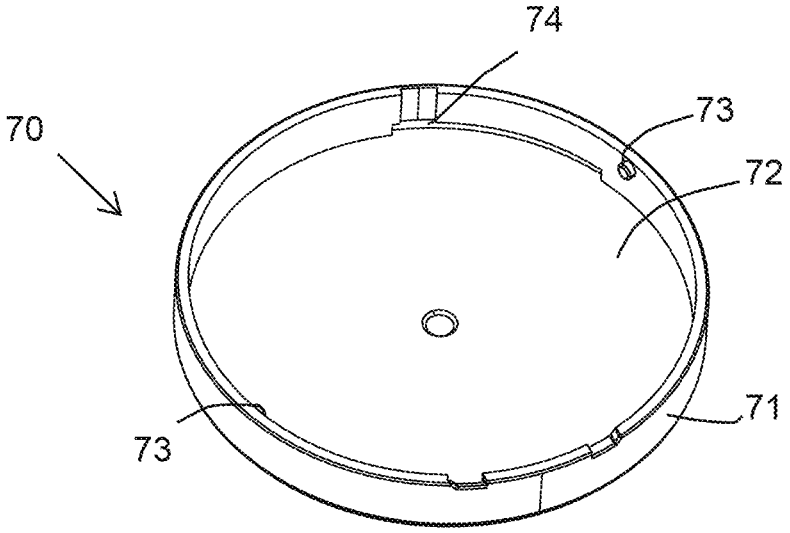
FIG. 8 illustrates a bottom perspective view of an outer cover of the airtight cosmetic compact of FIG. 3.
Figure 9:
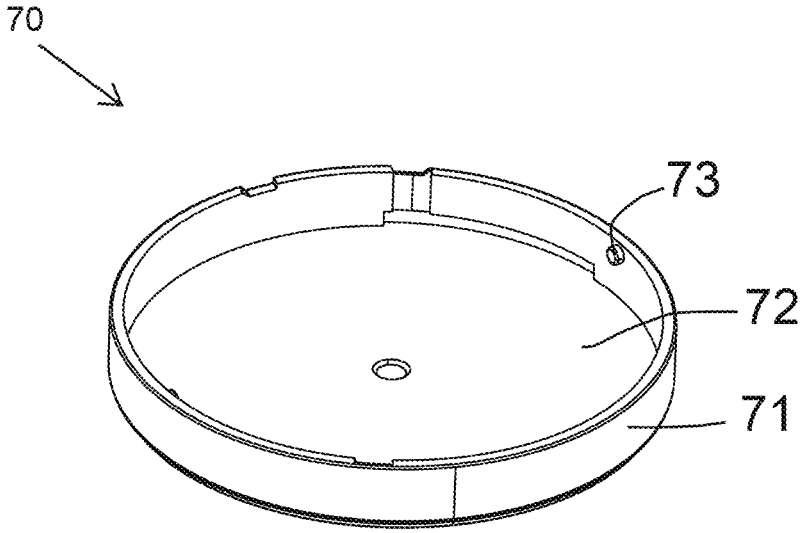
FIG. 9 illustrates another bottom perspective view of the outer cover of the airtight cosmetic compact of FIG. 3.

Referring to FIGS. 8 and 9, the outer cover 70 of the airtight cosmetic compact 100 is shown. The outer cover 70 is generally cylindrical in shape with a closed upper end and an open bottom end. The outer cover 70 has a sidewall 71 extending from a peripheral edge of an upper wall 72 thereof. The inner surface of the sidewall 71 of the outer cover 70 includes two lugs 73 that are diametrically opposite. As the outer cover 70 is turned, the two lugs 73 travel along the camming ramps 34 located on the inner tray 30. This action results in the axial movement of the inner tray 30 relative to the base part 10.

The outer cover 70 has two grooves 74 on its sidewall 71, adjacent to the bottom wall 72, positioned diametrically opposite each other. These grooves 74 engage with two outer protrusions 63 located on the inner cover 60, enabling the outer cover 70 to have a limited rotational movement in relation to the inner cover 60 along an outer circumference of the inner cover 60. Rotation of the outer cover 70 is limited to about 20-40 degrees by engagement of the grooves 74 and the outer protrusions 63, more particularly the rotation of the outer cover 70 is limited to about 35 degrees.

Figure 10:
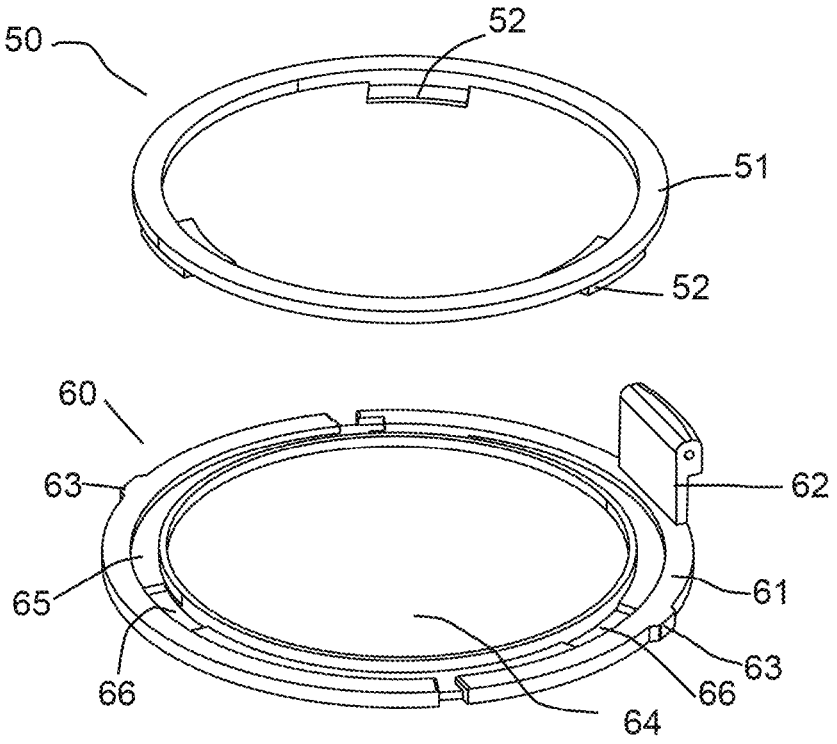
FIG. 10 illustrates a bottom perspective view of an inner tray of the airtight cosmetic compact of FIG. 3, with a gasket thereof shown in separated state.

FIG. 10 illustrates the inner cover 60 from a bottom perspective view, along with the separated gasket 50. The inner cover 60 has a flat circular disc wall 61, from which a hinge bracket 62 extends downward from an inner surface of the flat circular disc wall 61 close to peripheral edge thereof. This hinge bracket 62 provides a pivotal connection between the base part 10 and the inner cover 60. The flat circular disc wall 61 has the two outer protrusions 63 that are diametrically opposite and that extend radially outward from the peripheral edge of the flat circular disc wall 61.

Additionally, the inner cover 60 has a well area 64 on inner surface of the flat circular disc wall 61 to house the mirror 40. Furthermore, the inner surface of the flat circular disc wall 61 of the inner cover 60 has an annular grooved area 65 close to the peripheral edge of the inner cover 60 to receive the gasket 40 therein. The annular grooved area 65 of the flat circular disc wall has through slots 66 formed therein to receive locking projections 52 of the gasket 50.

Referring to FIGS. 3 and 10, the gasket 50 has a flat ring structure 51, and has locking projections 52 formed on an upper surface thereof. The locking projections 52 has width greater than the width of the flat ring structure 51. The flat ring structure 51 is received into the annular grooved area 65 of the inner cover 60 and the locking projections 52 are received in the through slots 66 of the inner cover 60.

Figure 2:
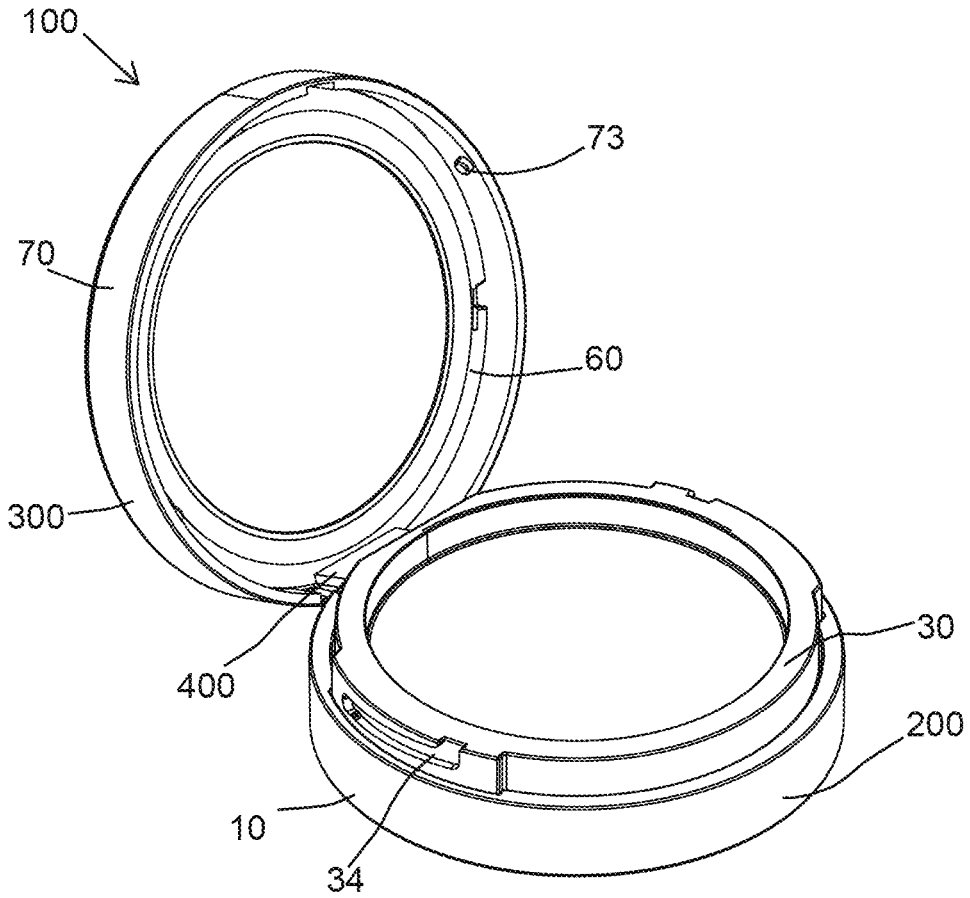
FIG. 2 illustrates a perspective view of the airtight cosmetic compact of FIG. 1 in an open position.
Figure 13:
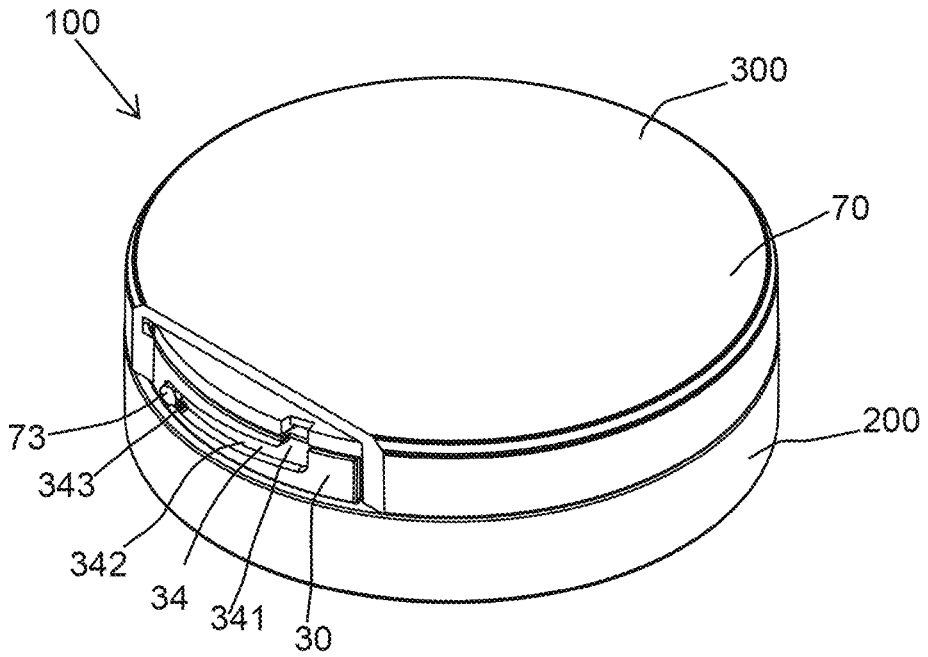
FIG. 13 illustrates a partial perspective of the airtight cosmetic compact of FIG. 1, wherein the airtight cosmetic compact is in a locked and closed position.
Figure 14:
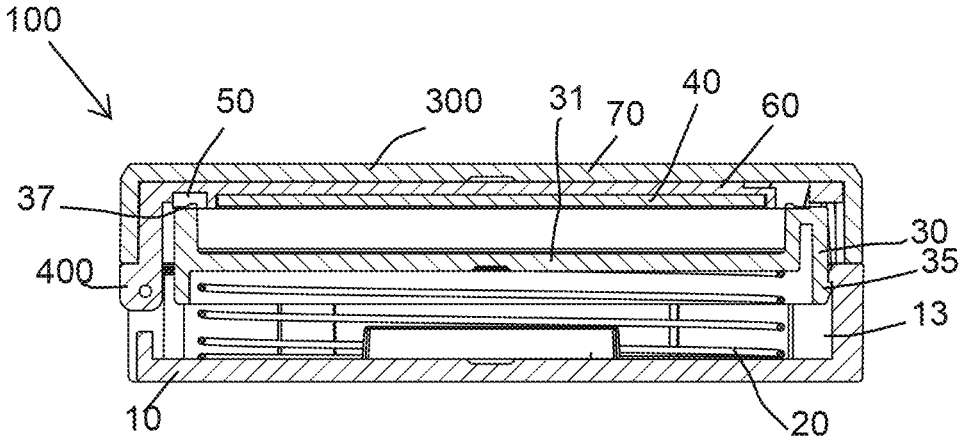
FIG. 14 illustrates a cross-sectional view of the airtight cosmetic compact of FIG. 13.

During use, when the outer cover 70 is rotated to the closed and locked position, the two lugs 73 travel in the camming ramps 34 of the inner tray 30, which allow the cover assembly 300 to directly compress the gasket 50 to the rim 37 of the inner tray 30 (See FIGS. 4, 13 and 14). Further, when the outer cover 70 is rotated to the open position the two lugs 73 travel out from the camming ramps 34 of the inner tray 30, which provides for the cover assembly 300 to be pivoted away from base assembly 106 and into the open position as illustrated in FIGS. 2 and 5.

As shown in FIG. 5, the cosmetic compact 100 is in the open position. In the open position of the cosmetic compact 100, the elastic member 20 biases the inner tray 30 to its maximum upward slide limit. To close the cosmetic compact 100, the cover assembly 300 is pivotally rotated along the hinge assembly 400 to cover an open upper end of the base assembly 200. Next, the outer cover 70 is rotated around the central axis X of the cosmetic compact 100. This action causes each of the two lugs 73 on the outer cover 70 to enter the corresponding camming ramps 34 through the inlet groove parts 341. The lugs 73 then descend along the inclined groove parts 342, overriding the locking protrusion 343 near the lower end of the inclined groove parts 342, thereby locking the cover assembly 300 onto the base assembly 200.

Figure 11:
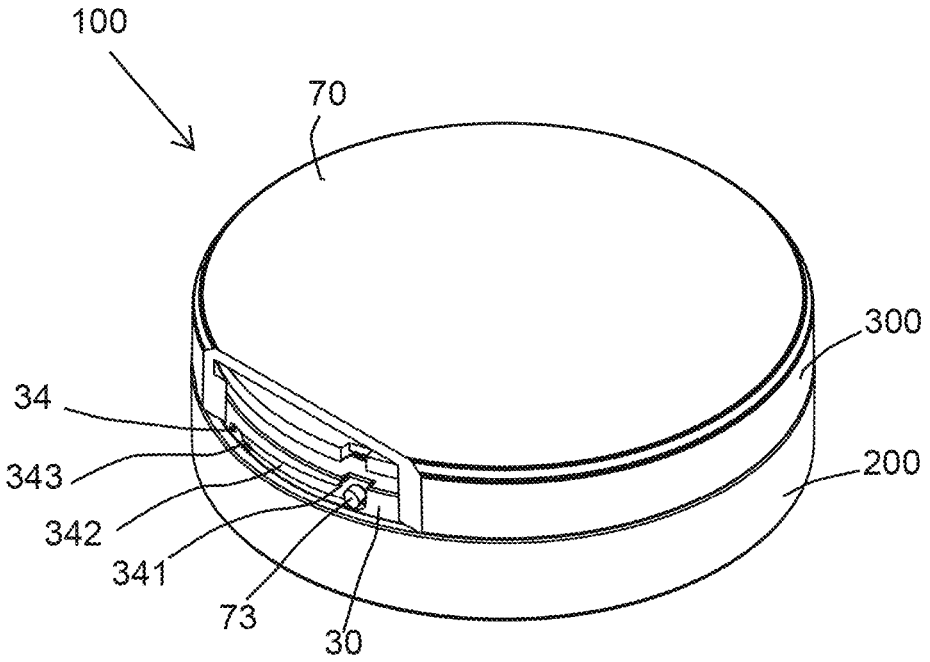
FIG. 11 illustrates a partial perspective of the airtight cosmetic compact of FIG. 1, wherein the airtight cosmetic compact is in unlocked and closed position.
Figure 12:
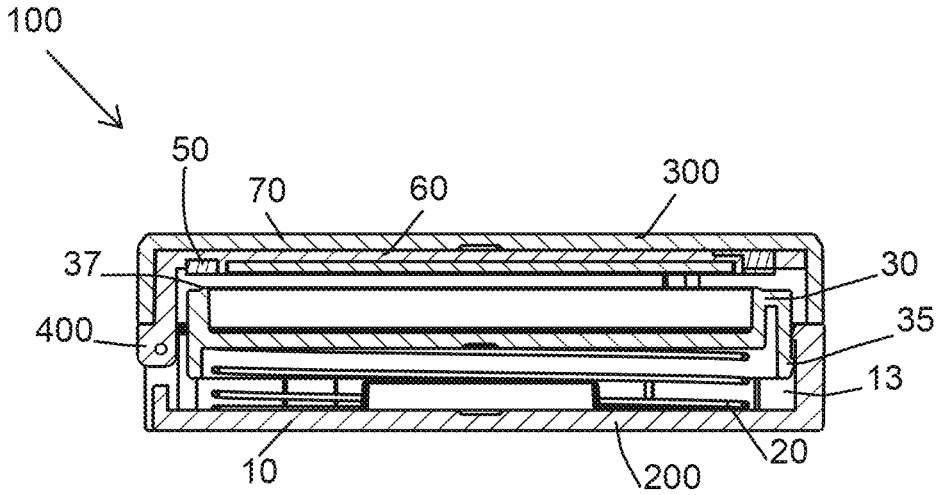
FIG. 12 illustrates a cross-sectional view of the airtight cosmetic compact of FIG. 11.

As the two lugs 73 enter the camming ramp 34 through the inlet groove parts 341, the inner tray 30 is pushed down slightly against the upward biasing force of the elastic member 20, refer FIGS. 11 and 12. With further rotation of the outer cover 70, each of the two lugs 73 travels along the corresponding inclined groove parts 342 towards the lower end of the camming ramps 34, pushing the inner tray 30 in the axial upward direction. The lugs 73 then reach the lower end of the camming ramps 34, overriding the locking protrusion 343, locking the cover assembly 300 onto the base assembly 200. Also, at the locking position, the inner tray 30 reaches its maximum upward slide limit. In this position, the rim 37 of the inner tray 30 snugly abuts the gasket 50 of the cover assembly 300, creating an airtight seal, refer FIGS. 13 and 14.

The cosmetic compact 100 is brought in the open position from the closed position by rotating the outer cover 70 about the central axis X of the cosmetic compact 100. On rotating the outer cover 70, the two lugs 73, initially located at the lower end of the camming ramps 34 on the inner tray 30, override the locking protrusions 343 to travel along the inclined groove parts 342 towards inlet groove parts 341 to exit the camming ramps. As the two lugs 73 travel along the inclined groove parts 342 and inlet groove parts 341, the inner tray 30 is forced to move downward relative to the base part 10, breaking the airtight seal between the rim 37 of the inner tray 30 and the gasket 50. Once the two lugs 73 disengage from the camming ramps 34, the cover assembly 300 and base assembly 200 are no longer locked together. Subsequently, the inner tray 30 is pushed upward by the biasing force of the elastic member 20, returning to its maximum upward slide limit position. The cover assembly 300 is then pivoted about the hinge to open the cosmetic compact 100, allowing the consumer access to the cosmetic product stored in the inner tray 30.

The base part 10, inner tray 30, outer cover 70 and inner cover 60 may be made of plastic such as ABS, SAN, or metal, or any other suitable material, or the like that is suitable and provide the structural strength necessary for mechanical.

The airtight cosmetic compact 100 of the present disclosure is simple in its design and offer a highly effective seal for the cosmetic product stored inside, even over long durations. This design greatly minimizes the risk of evaporation of volatile cosmetic product in the stored cosmetic product.

The present disclosure is not limited to, the broadest in accordance with the basic idea disclosed herein. It should be interpreted as having a range. Skilled artisans may implement the pattern of the non-timely manner by combining, replacement of the disclosed embodiments shape, this would also do not depart from the scope of the invention. In addition, those skilled in the art may readily change or modifications to the disclosed embodiments, based on the present specification, such changes or modifications also belong to the scope of the present disclosure will be apparent.

What is claimed is:

1. An airtight cosmetic compact comprising:

a base assembly including a base part and an inner tray having a reservoir for storing a cosmetic product;

a cover assembly pivotally and rotatably coupled to the base assembly, the cover assembly including an outer cover, an inner cover, and a gasket;

wherein the inner cover of the cover assembly is pivotally connected with the base assembly, and the outer cover of the cover assembly is rotatably connected to the base assembly;

wherein the outer cover has a limited rotational movement in relation to the inner cover;

wherein the gasket is coupled to an inner surface of the inner cover, and wherein an upper rim of the inner tray abuts the gasket to provide an airtight seal when the airtight cosmetic compact is in a closed and locked position;

wherein the inner tray is accommodated at least partially within the base part, the inner tray is movable axially relative to the base part when the outer cover is twisted to open or close the airtight cosmetic compact; and wherein an elastic member is positioned between the inner tray and the base part to elastically bias the inner tray in an upward direction.

2. The airtight cosmetic compact of claim 1, wherein the base part includes a bottom wall, a circumferential sidewall extending upward from a peripheral edge of the bottom wall; and wherein the inner tray includes the bottom wall and a sidewall extending upwardly from a peripheral edge of the bottom wall of the inner tray.

3. The airtight cosmetic compact of claim 2, wherein a side recess is formed in the base part so as to be hinged to a hinge bracket of the inner cover using a hinge shaft.

4. The airtight cosmetic compact of claim 2, wherein an inner surface of the circumferential sidewall of the base part includes two axial guide grooves that extend from a distal end toward a proximal end of the circumferential sidewall; and wherein an outer surface of the sidewall of the inner tray includes radially outward projections that are configured to engage and move along the two axial guide grooves in the base part.

5. The airtight cosmetic compact of claim 4, wherein each of the radially outward projections of the inner tray includes a camming ramp; wherein each of the camming ramps has an inlet groove part, an inclined groove part and a locking protrusion formed near a lower end of the inclined groove part; and wherein an inner surface of a sidewall of the outer cover includes two lugs that travel along the camming ramp located on the inner tray when the outer cover is twisted to bring the airtight cosmetic compact in an open and closed position.

6. The airtight cosmetic compact of claim 5, wherein the outer cover has two grooves on its sidewall, adjacent to a bottom wall thereof, positioned diametrically opposite each other; and wherein the two grooves engage with two outer protrusions located on an outer periphery of the inner cover, enabling the outer cover to have a limited rotational movement in relation to the inner cover.

7. The airtight cosmetic compact of claim 2, wherein an inner surface of the circumferential sidewall of the base part includes slide limiting grooves; and an outer surface of the sidewall of the inner tray have limiting protrusions at a lower end portion thereof; and wherein the limiting protrusions are configured to abut upper ends of the slide limiting grooves to limit an upward travel of the inner tray relative to the base part.

8. The airtight cosmetic compact of claim 2, wherein the base part includes at least two arch-shaped ribs extending upward from an inner surface of the bottom wall; and a lower end of the clastic member abuts and surrounds the two arch-shaped ribs, and an upper end of the elastic member abuts a bottom surface of a bottom wall of the inner tray.

9. The airtight cosmetic compact of claim 1, wherein the inner cover has a flat circular disc wall, from which a hinge bracket extends downward from an inner surface of the flat circular disc wall close to a peripheral edge thereof; and wherein the flat circular disc wall has the two outer protrusions that are diametrically opposite and that extend radially outward from the peripheral edge of the flat circular disc wall.

10. The airtight cosmetic compact of claim 9, wherein the inner cover has a well area on an inner surface of the flat circular disc wall to house a mirror; wherein the inner surface of the flat circular disc wall has an annular grooved area close to the peripheral edge of the inner cover to receive the gasket therein; wherein the annular grooved area of the flat circular disc wall has through slots formed therein; and wherein a flat ring structure of the gasket is received into the annular grooved area of the inner cover and locking projections formed on an upper surface of the gasket are received in the through slots of the inner cover.

11. The airtight cosmetic compact of claim 1, wherein when the outer cover is rotated to the closed position, two lugs travel of the outer cover into camming ramps located on an outer surface of the inner tray, to directly compress the gasket to a rim of the inner tray; and wherein when the outer cover is rotated to an open position, the two lugs travel out from the camming ramps of the inner tray, allowing the cover assembly to be pivoted away from the base assembly and into an unlocked and open position.

12. The airtight cosmetic compact of claim 1, wherein the rotation of the outer cover is limited to about 35 degrees.

13. An airtight cosmetic compact comprising:

a base assembly including a base part with an accommodating cavity and an inner tray having a reservoir for storing a cosmetic product;

a cover assembly pivotally coupled to the base assembly, the cover assembly including an outer cover, an inner cover, and a gasket;

wherein the inner cover of the cover assembly is pivotally connected with the base assembly, and the outer cover of the cover assembly is rotatably connected to the base assembly;

wherein the outer cover has limited rotational movement in relation to the inner cover;

wherein the gasket is coupled to an inner surface of the inner cover, and wherein an upper rim of the inner tray abuts the gasket to provide an airtight seal when the airtight cosmetic compact is in a closed and locked position;

wherein the inner tray is accommodated at least partially within the base part, the inner tray is movable axially relative to the base part when the outer cover is twisted to open or close the airtight cosmetic compact; and wherein an elastic member is positioned between the inner tray and the base part to elastically bias the inner tray in an upward direction;

wherein an inner surface of a sidewall of the outer cover includes two lugs that are diametrically opposite;

wherein an outer surface of a sidewall of the inner tray includes camming ramps, each of the camming ramps has an inlet groove part, an inclined groove part and a locking protrusion formed near a lower end of the inclined groove part;

wherein in the open position, the elastic member biases the inner tray to its maximum upward limit;

wherein to close the airtight cosmetic compact, the outer cover is rotated around a central axis of the airtight cosmetic compact, causing the two lugs to enter the camming ramps via the inlet groove parts and which in turn push the inner tray slightly downward against the elastic member; wherein further rotation moves the two lugs along the inclined groove parts to push the inner tray upward so that the upper rim of the inner tray abuts the gasket; wherein when the two lugs reach lower ends of the camming ramps, the two lugs override the locking protrusions, locking the cover assembly and creating an airtight seal; and wherein to open the airtight cosmetic compact, the outer cover is rotated to move the two lugs along the inclined groove parts and out of the camming ramps, breaking the airtight seal between the inner tray and the gasket, and the cover assembly is pivoted open to allow access to a cosmetic product, when stored in the inner tray.

14. The airtight cosmetic compact of claim 13, wherein an outer surface of a sidewall of the inner tray includes radially outward projections that are configured to move along corresponding two axial guide grooves located in an inner surface of a sidewall of the base part.

15. The airtight cosmetic compact of claim 14, wherein the camming ramps are located on the radially outward projections of the inner tray.

16. An airtight cosmetic compact comprising:

a base assembly including a base part and an inner tray having a reservoir for storing a cosmetic product;

a cover assembly pivotally and rotatably coupled to the base assembly, the cover assembly including an outer cover, an inner cover, and a gasket;

wherein the inner cover of the cover assembly is pivotally connected with the base assembly, and the outer cover of the cover assembly is rotatably connected to the base assembly;

wherein the outer cover has limited rotational movement in relation to the inner cover;

wherein the gasket is coupled to an inner surface of the inner cover, and wherein an upper rim of the inner tray abuts the gasket to provide an airtight seal when the airtight cosmetic compact is in a closed and locked position;

wherein the inner tray is accommodated at least partially within the base part, the inner tray is movable axially relative to the base part when the outer cover is twisted to open or close the airtight cosmetic compact;

wherein an inner surface of a sidewall of the outer cover includes two lugs that are diametrically opposite;

wherein an outer surface of the sidewall of the inner tray includes camming ramps, each of the camming ramps has an inlet groove part, an inclined groove part and a locking protrusion formed near a lower end of the inclined groove part;

wherein to close the airtight cosmetic compact, the outer cover is rotated around a central axis of the airtight cosmetic compact, causing the two lugs to enter the camming ramps via the inlet groove parts; wherein further rotation of the outer cover moves the two lugs along the inclined groove parts to push the inner tray upward so that an upper rim of the inner tray abuts the gasket; wherein when the two lugs reach lower ends of the camming ramps, the two lugs override the locking protrusions, locking the cover assembly and creating an airtight seal between the upper rim of the inner tray and the gasket.

17. The airtight cosmetic compact of claim 16, wherein an elastic member is positioned between the inner tray and the base part to elastically bias the inner tray in an upward direction; and wherein when the two lugs enter the camming ramps via the inlet groove parts, the two lugs push the inner tray slightly downward against the elastic member.

18. The airtight cosmetic compact of claim 16, wherein an outer surface of a sidewall of the inner tray includes radially outward projections that are configured to move along corresponding two axial guide grooves located in an inner surface of a sidewall of the base part; and wherein the camming ramps are located on the radially outward projections of the inner tray.

19. The airtight cosmetic compact of claim 18, wherein each of the two axial guide grooves may span about 55 degrees in circumferential direction.

20. The airtight cosmetic compact of claim 16, wherein the outer cover has two grooves on its sidewall, adjacent to a bottom wall thereof, positioned diametrically opposite each other; and the two grooves engage with two outer protrusions located on an outer periphery of the inner cover, enabling the outer cover to have a limited rotational movement in relation to the inner cover along an outer circumference of the inner cover; and wherein the rotation of the outer cover is limited to about 35 degrees by engagement of the two grooves and the two outer protrusions.

* * * * *